US007603967B2

(12) United States Patent
Garrabrant

(10) Patent No.: US 7,603,967 B2
(45) **Date of Patent: *Oct. 20, 2009**

(54) WATER HEATER WITH FLAMMABLE VAPOR SENSOR

(75) Inventor: Michael A. Garrabrant, Unicoi, TN (US)

(73) Assignee: American Water Heater Company, Atlanta, GA (US)

( * ) Notice: Subject to any disclaimer, the term of this patent is extended or adjusted under 35 U.S.C. 154(b) by 105 days.

This patent is subject to a terminal disclaimer.

(21) Appl. No.: 11/724,376

(22) Filed: Mar. 15, 2007

(65) Prior Publication Data

US 2007/0215067 A1 Sep. 20, 2007

Related U.S. Application Data

(60) Provisional application No. 60/784,143, filed on Mar. 20, 2006.

(51) Int. Cl.
*F24H 1/18* (2006.01)

(52) U.S. Cl. ..... 122/13.01; 122/18.3

(58) Field of Classification Search ..... 122/13.01, 122/14.1, 14.2, 18.3, 19.1, 155.2; 431/6, 431/13, 16, 22; 126/361.1

See application file for complete search history.

(56) References Cited

U.S. PATENT DOCUMENTS

| | | | | |
|---|---|---|---|---|
| 6,622,661 | B1 * | 9/2003 | Hotton | 122/13.01 |
| 6,626,133 | B2 * | 9/2003 | Schell et al. | 122/504 |
| 6,662,661 | B2 | 12/2003 | Stach et al. | |
| 6,722,876 | B2 * | 4/2004 | Abraham et al. | 431/22 |
| 6,766,771 | B1 * | 7/2004 | Hotton | 122/14.2 |
| 6,973,819 | B2 * | 12/2005 | Ruhland et al. | 73/23.31 |
| 7,112,059 | B2 * | 9/2006 | Donnelly | 431/22 |
| 7,159,540 | B2 * | 1/2007 | Garrabrant et al. | 122/13.01 |
| 7,290,502 | B2 * | 11/2007 | Kidd et al. | 122/14.2 |

* cited by examiner

*Primary Examiner*—Gregory A Wilson
(74) *Attorney, Agent, or Firm*—Michael Best & Friedrich LLP

(57) ABSTRACT

A water heater including a water container, a combustion chamber adjacent the water container, a burner associated with the combustion chamber, a blower located to receive combustion products generated by the burner, an intake air conduit connected to the combustion chamber and having a combustion air intake opening, a dilution air conduit connected to the blower and having a dilution air intake opening; and a flammable vapor sensor having at least an operative portion positioned in the blower or the dilution air conduit.

29 Claims, 5 Drawing Sheets

WATER HEATER WITH FLAMMABLE VAPOR SENSOR

RELATED APPLICATION

This patent application claims the benefit of U.S. Provisional Application No. 60/784,143, filed Mar. 20, 2006. This earlier provisional application is hereby incorporated by reference.

TECHNICAL FIELD

The technology in this disclosure relates to power vented water heaters, particularly to power vented water heaters that have an air intake system with a flammable vapor sensor.

BACKGROUND

Power vented water heaters are often equipped with intermittent burner ignition devices such as spark or hot surface igniters that ignite the pilot or main burner system only when there is a demand for hot water. Alternatively, the pilot burner may continuously operate in standing pilot type of ignition systems. Standing pilot ignition systems are less energy efficient and are manually re-lit after a power outage. This results in a significant preference in the market place for intermittent ignition systems.

However, intermittent ignition systems pose challenges regarding reducing the likelihood of igniting flammable vapors outside the power vented water heater since typical flame arrestor technology using intermittent ignition systems has proven challenging for a number of reasons. A power vented water heater typically uses a blower positioned directly above the flue to move combustion products from the ambient space surrounding the heater into the water heater and exhaust the products of combustion outside. Typical power vented water heaters have two sources of intake air. One source is for combustion, wherein combustion air flows through the combustion chamber and flue. One source causes air to flow directly into the blower to reduce the temperature of the exhaust gases. This allows the vent system to utilize PVC, ABS or CPVC venting. When the water heater burner is off, i.e., in standby mode, the blower does not operate nor is there pilot or main burner operation. When there is a call for heat, the blower typically operates for a short pre-purge period to establish that there is sufficient airflow through the water heater system to support combustion and vent combustion products outside. Measures have been taken to minimize the likelihood that flammable vapors, located in the vicinity of the water heater, could be drawn into the combustion chamber and ignited by the burner or igniter (reference U.S. Pat. No. 6,662,661, Fuel-Fired Heating . . . ). However, in the highly unlikely event that flammable vapors may be present at a location above the water heater, additional measures could theoretically be helpful.

SUMMARY

I provide a water heater including a water container, a combustion chamber adjacent the water container, a burner associated with the combustion chamber, a blower located to receive combustion products generated by the burner, an intake air conduit connected to the combustion chamber and having a combustion air intake opening, a dilution air conduit connected to the blower and having a dilution air intake opening, and a flammable vapor sensor having at least an operative portion positioned in the blower or the dilution air conduit.

I also provide a water heater including a water container, a combustion chamber adjacent the water container, a burner associated with the combustion chamber, a blower assembly located to receive combustion products generated by the burner, an intake air conduit sealingly connected to the combustion chamber and having a combustion air intake opening located adjacent an upper portion of the water heater, a dilution air conduit sealingly connected to the blower assembly and having a dilution air intake opening, and a flammable vapor sensor having at least an operative portion positioned in the blower assembly or the dilution air conduit.

I further provide a water heater including a water container, a combustion chamber adjacent the water container, a burner associated with the combustion chamber, a blower located to receive combustion products generated by the burner, an intake air conduit connected to the combustion chamber and having a combustion air intake opening, a dilution air conduit connected to the blower and having a dilution air intake opening, and a flammable vapor sensor having at least an operative portion positioned in the intake air conduit.

DETAILED DESCRIPTION

Figure 1:
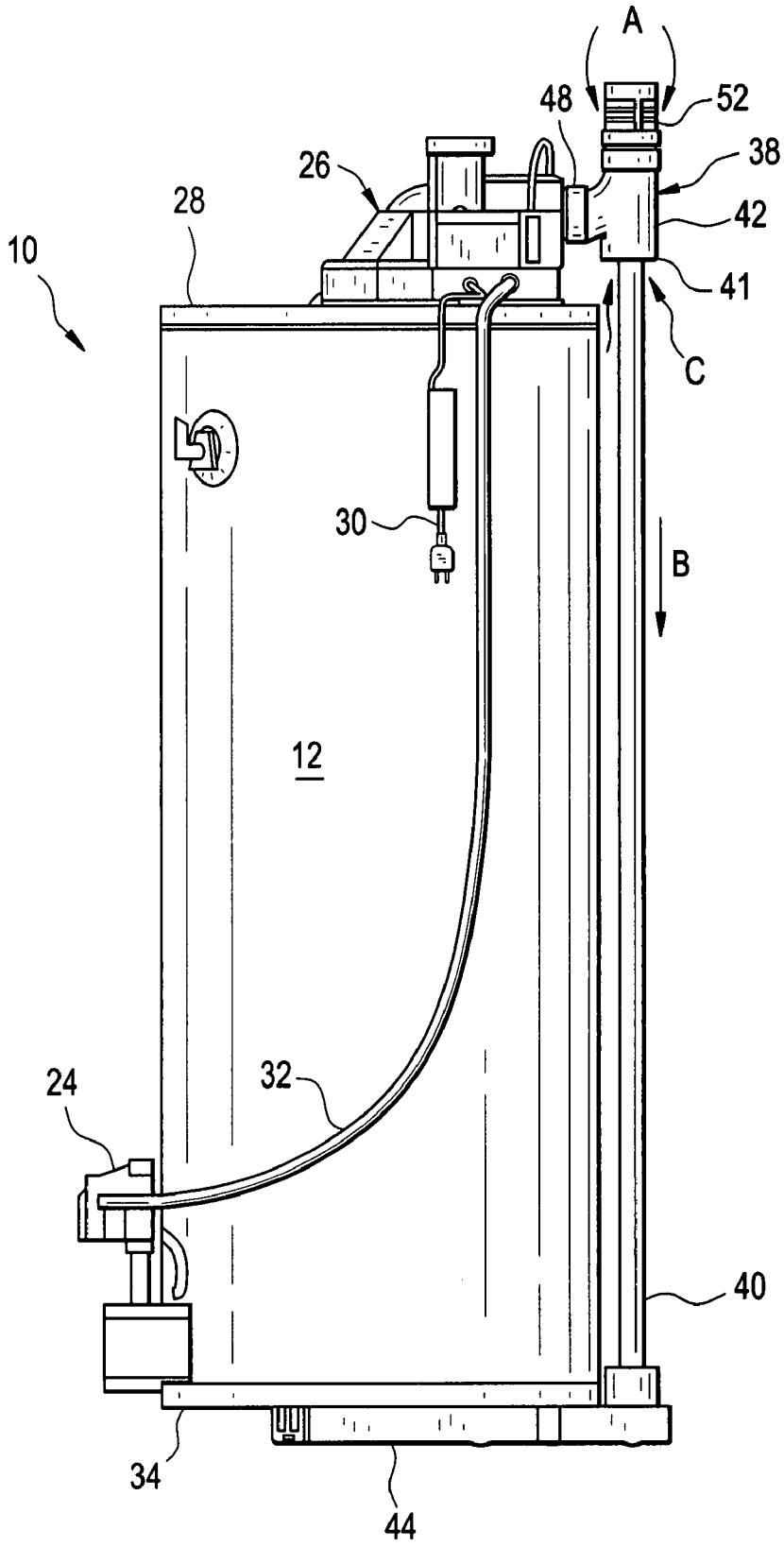
FIG. 1 is a side elevational view of a water heater.

It will be appreciated that the following description is intended to refer to specific aspects of the structure selected for illustration in the drawings and is not intended to define or limit this disclosure, other than in the appended claims.

Water heaters described herein assist in reducing the likelihood that flammable vapors outside a water heater will be ignited by the water heater itself. This is achieved in one aspect with a concentric, bi-directional air intake system that directs separate air intake paths to the water heater blower and vent system. One air intake path provides air for combustion and may be located above the dilution air intake for the blower. The intake pipe may be a large diameter pipe that allows air for dilution of the combustion exhaust products to be drawn from above the tank and directly into the blower and exhausted to the outside. Inside of the large diameter air intake pipe is a smaller pipe that permits air for combustion to be drawn from the top of the water heater or above the blower and travel down to a sealed combustion chamber. These bi-directional air paths are separate and do not intermix. A flammable vapor sensor may be placed in the blower and/or the dilution air intake and/or the intake air conduit that can shut off the burner when the concentration of vapors approaches LFL (low flammability level) proximate the upper portion of the water heater.

Turning now to the drawings, selected aspects of a water heater 10 are shown. Water heater 10 includes, but is not limited to, a jacket 12, insulation 14, tank 16, combustion chamber 18 and burner 20. A flue 22 extends longitudinally substantially concentrically within tank 16 from an uppermost portion (tank head) to a lowermost portion (tank bottom). Combustion chamber 18 contains burner 20 which connects to a fuel supply line 23. Fuel supply line 23 connects to gas control valve 24 that connects to a fuel supply (not shown).

A blower assembly 26 is positioned on the top pan 28 of water heater 10 and sealingly connects to flue 22 at its upper terminus. Accordingly, exhaust/combustion gases generated by burner 20 flow upwardly through flue 22 and into blower assembly 26. Blower assembly 26 has an electrical supply cord 30 that may be "plugged in" a typical electrical residential household socket, for example. Various electric control lines, such as wires, for example, may be contained within a conduit 32 connected between blower assembly 26 and gas valve 24. Alternatively, wireless technology, optical fibers or the like may be employed as a means to communicate between the gas control valve 24 and electrical components located remote from the gas control valve 24.

Water heater 10 has a bottom pan 34, i.e., the bottom of the jacket. Bottom pan 34 has an opening 46 through which combustion air passes and rests on legs 36 that support the entire water heater 10.

An air intake system 38 connects between blower assembly 26 and combustion chamber 18. Air intake system 38 includes an air intake conduit and a dilution air conduit. The air intake conduit includes a substantially vertically oriented portion 40 that extends alongside or adjacent jacket 12 of water heater 10. The air intake conduit also comprises a substantially horizontally oriented portion 44 that extends from the substantially vertically oriented portion 40 to opening 46 in bottom pan 34. Substantially vertically oriented portion 40 may extend upwardly beyond the top of blower assembly 26.

The dilution air conduit includes a substantially vertically oriented portion 42 located proximate blower assembly 26, although it may extend alongside or adjacent a portion of jacket 12. The dilution air conduit also includes a connector portion 48 that extends between blower assembly 26 and substantially vertically oriented portion 42. The length, shape, diameter and positioning of connector portion 48 may vary depending on the structure of the water heater, construction and position of blower assembly 26 and the structure and position of air intake system 38. Substantially vertically oriented portion 42 preferably has a perforated cap 52 at its uppermost portion and is positioned to allow ambient air to enter through perforated cap 52 and through an open end of substantially vertically oriented portion 40. Portions of substantially vertically oriented portion 40 and substantially vertically oriented portion 42 are preferably concentric.

Figure 2:
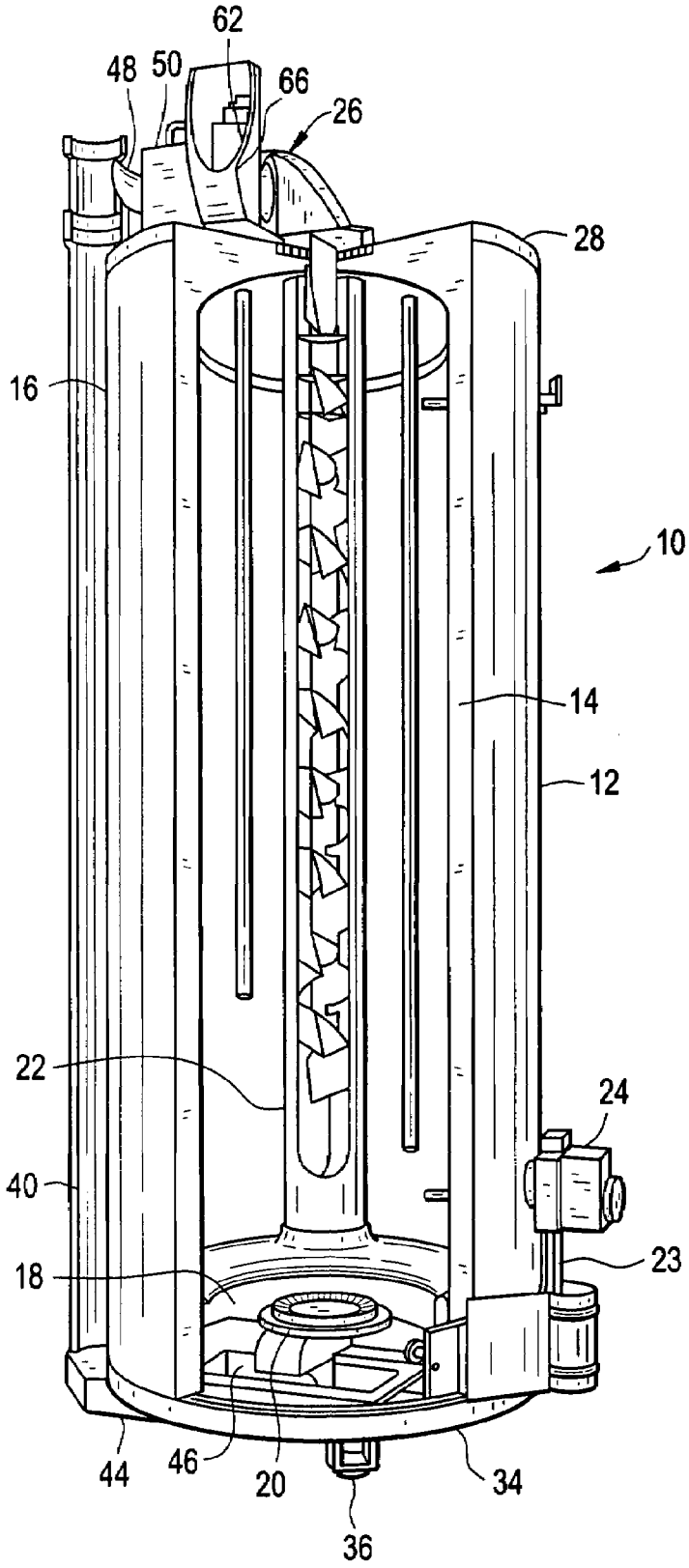
FIG. 2 is a partial sectional view of the water heater of FIG. 1.
Figure 3:
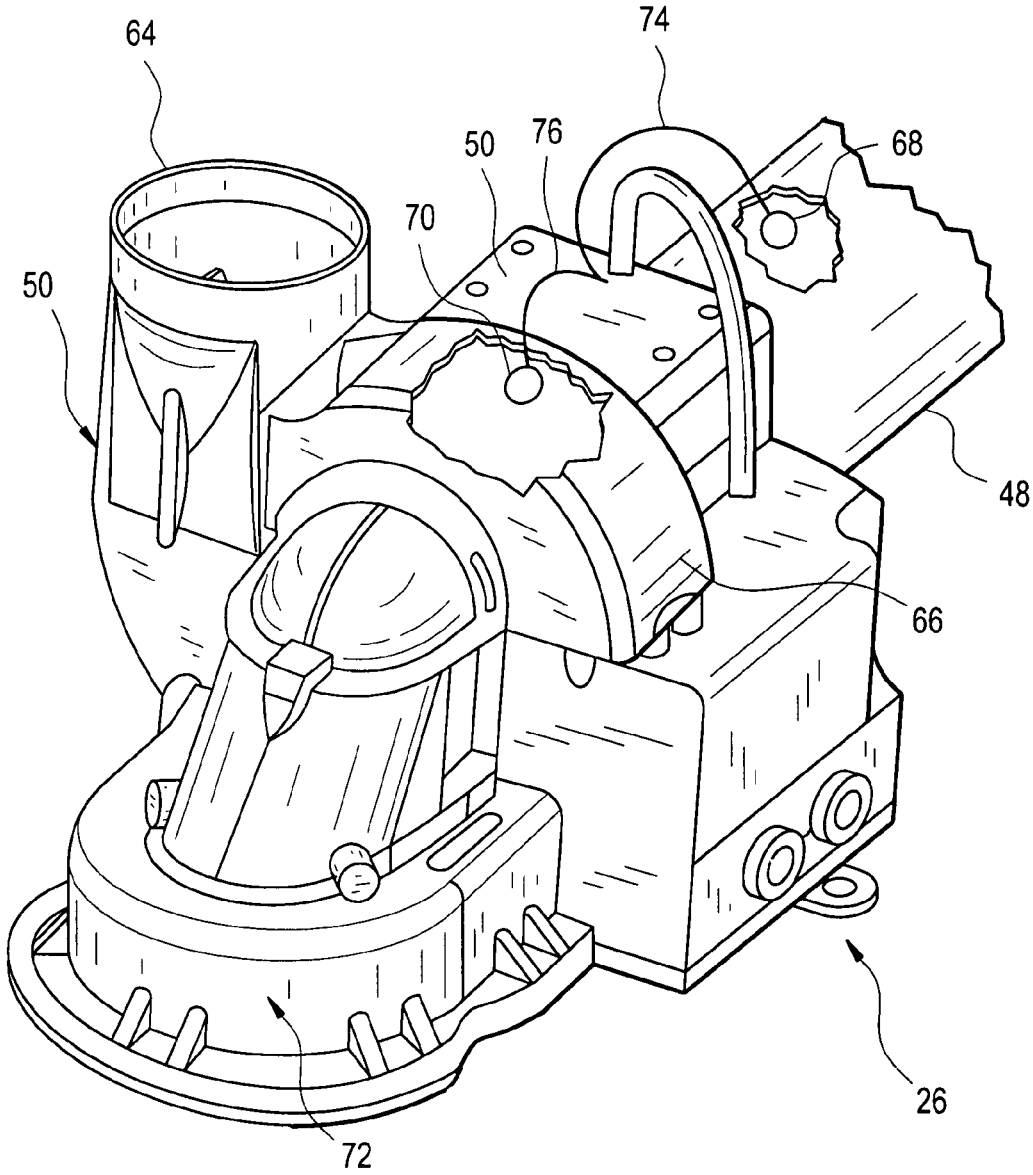
FIG. 3 is a perspective view, partially taken in section, of the blower assembly of FIG. 1.

As shown in FIGS. 2 and 3, blower assembly 26 comprises a blower 50 and a flue gas receiving hood 72. Blower 50 comprises a motor 60, air impeller 62, blower outlet 64 and impeller housing 66. Connector portion 48 extends between blower outlet 64 and substantially vertically oriented portion 42. A flammable vapor sensor 68 is shown in FIG. 3 located in connector portion 48. Similarly, a flammable vapor sensor 70 is located in blower outlet 64. Connection line 74 extends from sensor 68 into blower assembly 26 where it ultimately connects into conduit 32. Connection line 76 extends from sensor 70 into blower assembly 26 where it too ultimately connects into conduit 32.

Preferably, only one of sensor 68 and 70 is used, although both may be employed simultaneously. Also, sensors 68 and 70 may be used in connection with other flammable vapor sensors (not shown) positioned at other locations or other types of sensors (not shown). Any type of flammable vapor sensor known in the art may be used. One example includes sensors manufactured by Therm-O-Disc of Mansfield, Ohio.

Sensors 68 and 70 may be connected to gas control valve 24 by any means known in the art such as electrically by way of conduit 32, for example, or wireless or optical fibers, as other examples. Alternatively, sensors 68 and 70 may connect to a circuit or controller not directly associated with gas control valve 24 or positioned at a location remote from gas control valve 24.

Figure 4:
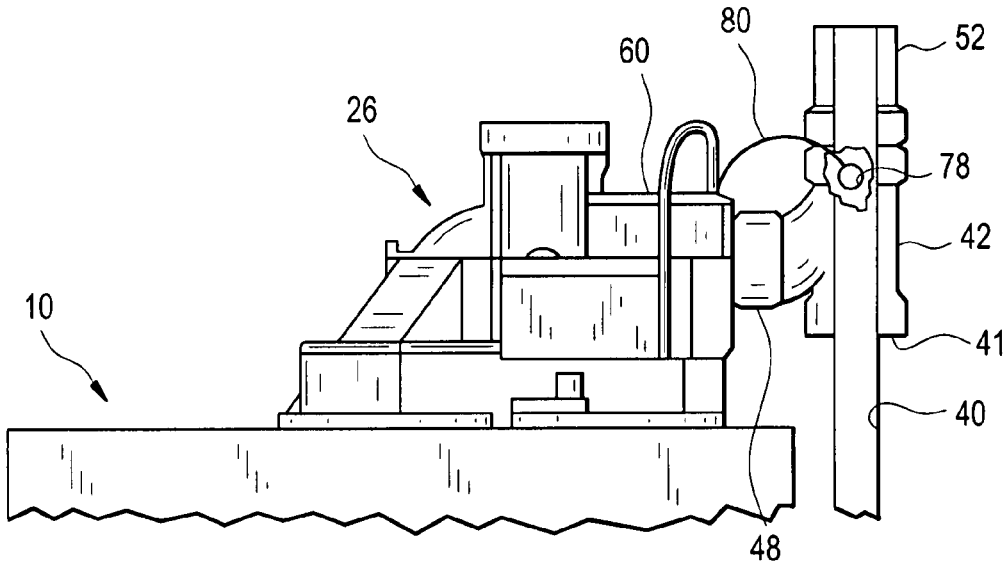
FIG. 4 is a side elevational view, partially taken in section, of the upper portion of a water heater similar to the water heater of FIG. 1.

FIG. 4 shows the top portion of a water heater 10 having a blower assembly 26. In the water heater of FIG. 4, a flammable vapor sensor 78 is positioned in substantially vertically oriented portion 40, which is the combustion air intake portion of air intake system 38. Flammable vapor sensor 78 connects to the portion of blower assembly 26 proximate motor 60 by way of connection line 80. Sensor 78, in a manner similar to sensors 68 and 70, may be connected to gas control valve 24 by any means known in the art, such as electrically by way of conduit 32, for example, or wireless or optical fibers, as other examples. Also, as in the case of sensors 68 and 70, sensor 78 may connect to a circuit or controller not directly associated with gas control valve 24 or positioned in a location remote from gas control valve 24.

Any or all of sensors 68, 70 and 78 may be positioned entirely within the blower assembly, dilution air intake or combustion air intake as appropriate. Alternatively, the operative portion may be located within the respective structure, with a mounting portion connected on the outside of the respective structure. Either construction is entirely within the scope of this disclosure and the means of positioning sensors 68, 70 and 78 is unimportant so long as the operative portion of the respective sensors is appropriately located.

Figure 5:
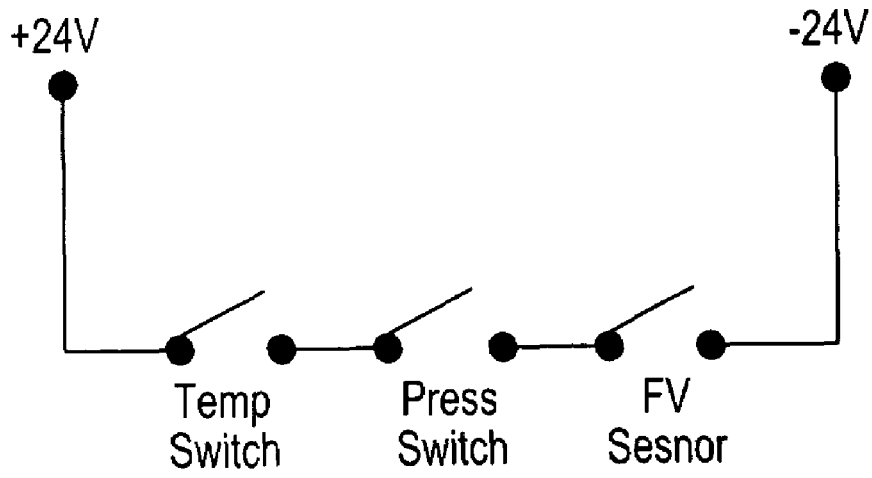
FIG. 5 is a schematic view of a representative circuit.
Figure 6:
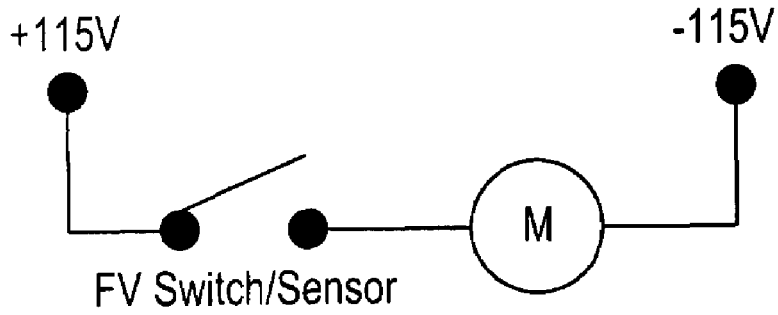
FIG. 6 is a schematic view of an alternative representative circuit.

FIGS. 5 and 6 show two representative examples of circuits that may be incorporated into gas control valve 24 or located elsewhere such as in a separate microcontroller that connects to gas control valve 24. These are merely representative circuits and other arrangements may be used.

During operation, burner 20 generates combustion/exhaust gases. Blower 50 initiates a flow of air and exhaust gases upwardly through flue 22. This also causes an upward flow of air/exhaust gases through combustion chamber 18. This in turn causes flow of air through opening 46 in bottom pan 34, which in turn causes flow of air through substantially horizontal portion 44 and substantially vertical portion 40. Combustion air enters air intake and exhaust system 38 by way of perforations in cap 52 as shown by arrows "A" in FIG. 3. Then, air flows downwardly through vertically oriented portion 40 as shown by arrow "B", into horizontally oriented portion 44, upwardly through opening 46 and into combustion chamber 18.

Substantially simultaneously, as shown in FIGS. 2 and 3, blower 50 causes the flow of dilution air to flow into opening 41 of substantially vertically oriented portion 42, into connector portion 48, to the impeller housing 66 to mix with flue gases entering flue gas receiving hood 72 of blower assembly 26 through flue 22, which decreases the temperature of the exhaust gases passing out of blower outlet 64 and provides for a range of types of exhaust lines (not shown), but which would extend in a direction "away" from water heater 10 in the Figures. The suction created by blower 50 causes air dilution to move through connector portion 48 and through opening 41 of substantially vertically oriented portion 42. With particular reference to FIG. 1, arrows "C" depict the entrance of dilution air through opening 41 in the lowermost portion of substantially vertically oriented portion 42. That lowermost opening 41 is preferably at a higher level than tank 16.

As dilution air flows upwardly through substantially vertically oriented portion 42, through connector portion 48 and into impeller housing 66 for combination with exhaust gases exiting from the terminus of flue 22, it can also draw in any flammable vapors present at that location in the unlikely event that such vapors rise to that elevated level. Those rare flammable vapors contact flammable vapor sensors 68 and/or 70. Detection of a selected level, amount or concentration of such vapors causes the sensor(s) to send a signal to gas control valve 24 (or other controller) to prevent the water heater from trying to light the pilot burner or shut off burner 20 if the water heater is in heating mode.

It can be seen, especially as shown in FIGS. 2 and 3, that simultaneous intake of combustion air and dilution air can occur from different locations and directions, and without intermixing. This can be achieved by the seal between combustion air pipe 40 and dilution air pipe 42. This simultaneous flow constriction, together with flammable vapor sensors 68 and/or 70, reduces the chances of undesirable flammable ignition of vapors that might rarely be located adjacent the water heater and provides for a means to lower the temperature of exhaust gases to increase flexibility of installation of the water heater.

Typical gasoline spills or other flammable vapors tend to migrate near the floor. Due to the difference in magnitude of the volume of the separate air paths (20% combustion air, 80% dilution air), it is less likely that vapor concentrations will exceed the LFL (lower flammability limit) at the combustion air inlet. The construction of this water heater avoids that problem and dilution air is drawn into the dilution air intake and exhausted harmlessly outside with the products from combustion. However, there can be unlikely instances when the concentration of flammable vapor may be sufficiently high to rise to the top of the water heater such that they could theoretically be drawn into connector portion 48 and/or blower assembly 26 and/or portion 40. In the unlikely event that flammable vapors reach this vertical height near the water heater, the sensor(s), control circuit and gas control valve 24 prevent the water heater from trying to light the pilot burner (if not currently in heating mode), or shuts down burner 20 if in heating mode. This water heater thereby further reduces the possibility of flammable vapors to enter the combustion chamber 18 where they could be ignited and can evacuate the flammable vapors from the space during operation, thereby reducing the potential that these vapors will build up and come in contact with another potential ignition source.

The size of the concentric portions can be increased or decreased to suit the application and/or size and/or shape of the water heater. The location of the various conduits relative to the water heater may also be varied depending on the size, shape and location of the water heater. The lower portion of the water heater may be the lower half of the water heater, but may be a larger portion so long as the dilution air intake opening is located below the combustion air opening. Conversely, the upper portion of the water heater may be the upper half of the water heater, but may be a larger portion so long as the combustion air opening is above the dilution air intake.

It will be understood that water heater 10 may be constructed with a wide variety of materials, in a wide variety of shapes and sizes. For example, any number of types of burners 20 may be employed, along with various types of blower assemblies 26, gas control valves 24 and the like. Also, various types of insulation, water containers/tanks and jackets may be employed. Preferably, air intake system 38 is constructed of PVC, ABS or CPVC materials, although other suitable materials may be employed.

Although this disclosure has been described in connection with specific forms thereof, it will be appreciated that a wide variety of equivalents may be substituted for the specified elements described herein without departing from the spirit and scope of this disclosure as described in the appended claims.

What is claimed is:

1. A water heater comprising:

a water container;

a combustion chamber adjacent the water container;

a burner associated with the combustion chamber;

a blower assembly located to receive combustion products generated by the burner;

an intake air conduit substantially sealingly connected to the combustion chamber and having a combustion air intake opening located adjacent an upper portion of the water heater;

a dilution air conduit substantially sealingly connected to the blower assembly and having a dilution air intake opening; and a flammable vapor sensor having at least an operative portion positioned in and/or at the blower assembly and/or the dilution air conduit.

2. The water heater of claim 1, wherein at least a portion of the dilution air conduit substantially concentrically surrounds at least a portion of the intake air conduit.

3. The water heater of claim 1, wherein the combustion air intake opening is located at a level higher than a location where the dilution air conduit connects to the blower assembly.

4. The water heater of claim 1, wherein the dilution air intake opening is at a level higher than the water container.

5. The water heater of claim 1, wherein the intake air conduit comprises a substantially vertically oriented portion extending along at least a portion of the length of the water heater, and a substantially horizontally oriented portion extending from the vertically oriented portion to an opening in the combustion chamber.

6. The water heater of claim 1, wherein the dilution air conduit comprises a substantially vertically oriented portion extending along at least a portion of the length of the water heater, and a connector portion extending between the blower assembly and the substantially vertically oriented portion.

7. The water heater of claim 6, wherein the operative portion of the sensor is located in the connector.

8. The water heater of claim 1, wherein the combustion air intake opening is covered with a perforated cap.

9. The water heater of claim 1, wherein the intake and dilution air conduits are substantially PVC, ABS and/or CPVC.

10. The water heater of claim 1, further comprising another flammable vapor sensor having at least an operative portion positioned in the intake air conduit.

11. A water heater comprising:

a water container;

a combustion chamber adjacent the water container;

a burner associated with the combustion chamber;

a blower assembly located to receive combustion products generated by the burner;

an intake air conduit substantially sealingly connected to the combustion chamber and having a combustion air intake opening located adjacent an upper portion of the water heater;

a dilution air conduit substantially sealingly connected to the blower and having a dilution air intake opening; and a flammable vapor sensor having at least an operative portion positioned in and/or at the blower assembly.

12. The water heater of claim 11, wherein at least a portion of the dilution air conduit substantially concentrically surrounds at least a portion of the intake air conduit.

13. The water heater of claim 11, wherein the combustion air intake opening is located at a level higher than a location where the dilution air conduit connects to the blower assembly.

14. The water heater of claim 11, wherein the dilution air intake opening is at a level higher than the water container.

15. The water heater of claim 11, further comprising another flammable vapor sensor having at least an operative portion positioned in and/or at the intake air conduit.

16. A water heater comprising:

a water container;

a combustion chamber adjacent the water container;

a burner associated with the combustion chamber;

a blower assembly located to receive combustion products generated by the burner;

an intake air conduit substantially sealingly connected to the combustion chamber and having a combustion air intake opening located adjacent an upper portion of the water heater;

a dilution air conduit substantially sealingly connected to the blower and having a dilution air intake opening;

a connector positioned between the blower assembly and the dilution air conduit; and a flammable vapor sensor having at least an operative portion positioned in and/or at the connector.

17. The water heater of claim 16, wherein the combustion air intake opening is located at a level higher than a location where the dilution air conduit connects to the blower assembly.

18. The water heater of claim 16, wherein the dilution air intake opening is at a level higher than the water container.

19. The water heater of claim 16, further comprising another flammable vapor sensor having at least an operative portion positioned in and/or at the intake air conduit.

20. A water heater comprising:

a water container;

a combustion chamber adjacent the water container;

burner associated with the combustion chamber;

a blower assembly located to receive combustion products generated by the burner;

an intake air conduit connected to the combustion chamber and having a combustion air intake opening;

a dilution air conduit connected to the blower assembly and having a dilution air intake opening; and a flammable vapor sensor having at least an operative portion positioned in and/or at the blower assembly or the dilution air conduit.

21. The water heater of claim 20, wherein at least a portion of the dilution air conduit substantially concentrically surrounds at least a portion of the intake air conduit.

22. The water heater of claim 20, wherein the combustion air intake opening is located at a level higher than a location where the dilution air conduit connects to the blower assembly.

23. The water heater of claim 20, wherein the dilution air intake opening is at a level higher than the water container.

24. The water heater of claim 20, further comprising another flammable vapor sensor having at least an operative portion positioned in and/or at the intake air conduit.

25. The water heater of claim 20, wherein the intake air conduit comprises a substantially vertically oriented portion extending along at least a portion of the length of the water heater, and a substantially horizontally oriented portion extending from the vertically oriented portion to an opening in the combustion chamber.

26. The water heater of claim 20, wherein the dilution air conduit comprises a substantially vertically oriented portion extending along at least a portion of the length of the water heater, and a connector portion extending between the blower assembly and the substantially vertically oriented portion.

27. The water heater of claim 26, wherein the operative portion of the sensor is located in the connector.

28. The water heater of claim 20, wherein the combustion air intake opening is covered with a perforated cap.

29. The water heater of claim 20, wherein the intake and dilution air conduits are substantially PVC, ABS and/or CPVC.

* * * * *

UNITED STATES PATENT AND TRADEMARK OFFICE

CERTIFICATE OF CORRECTION

PATENT NO. : 7,603,967 B2
APPLICATION NO. : 11/724376
DATED : October 20, 2009
INVENTOR(S) : Michael A. Garrabrant It is certified that error appears in the above-identified patent and that said Letters Patent is hereby corrected as shown below:

IN THE CLAIMS:

Column 7, line 38, claim 20 reads: "burner associated with the combustion chamber;"
Should read: "a burner associated with the combustion chamber;"

Signed and Sealed this
Fourteenth Day of February, 2012

David J. Kappos

David J. Kappos
*Director of the United States Patent and Trademark Office*